US011263927B2

(12) United States Patent
Curnew et al.

(10) Patent No.: US 11,263,927 B2
(45) Date of Patent: Mar. 1, 2022

(54) TAMPER EVIDENT LABEL AND ARTICLE INCORPORATING THE SAME

(71) Applicant: Custom Security Industries Inc., Thornhill (CA)

(72) Inventors: Lucien Curnew, Thornhill (CA); Robert Petryczka, Thornhill (CA); Morton Roseman, Thornhill (CA)

(73) Assignee: Custom Security Industries Inc., Ontario (CA)

( * ) Notice: Subject to any disclaimer, the term of this patent is extended or adjusted under 35 U.S.C. 154(b) by 0 days.

(21) Appl. No.: 16/597,472

(22) Filed: Oct. 9, 2019

(65) Prior Publication Data

US 2020/0111389 A1 Apr. 9, 2020

Related U.S. Application Data

(60) Provisional application No. 62/743,415, filed on Oct. 9, 2018.

(51) Int. Cl.
*G09F 3/00* (2006.01)

(52) U.S. Cl.
CPC ..... *G09F 3/0292* (2013.01)

(58) Field of Classification Search
CPC ..... G09F 3/0292
USPC ..... 281/81; 428/42.3
See application file for complete search history.

(56) References Cited

U.S. PATENT DOCUMENTS

| | | | | |
|---|---|---|---|---|
| 7,166,345 | B2 * | 1/2007 | Myers | G09F 3/0292 283/81 |
| 8,312,655 | B2 * | 11/2012 | Liu | G09F 3/0292 283/81 |
| 10,431,124 | B2 * | 10/2019 | Esmail | G09F 3/0292 |
| 2004/0112010 | A1 * | 6/2004 | Richards | G09F 3/0292 53/415 |

FOREIGN PATENT DOCUMENTS

| | | | | |
|---|---|---|---|---|
| FR | 2957181 | A1 * | 9/2011 | G09F 3/0292 |
| JP | 2006023348 | A * | 1/2006 | |
| JP | 2008301912 | A * | 12/2008 | |
| WO | WO-2018145713 | A1 * | 8/2018 | G09F 3/0292 |

OTHER PUBLICATIONS

JP-2008301912-A English Translation (Year: 2008).*

* cited by examiner

*Primary Examiner* — Kyle R Grabowski
(74) *Attorney, Agent, or Firm* — Fay Sharpe LLP

(57) ABSTRACT

A tamper evident label is formed of destructible material and has opposite major surfaces. One of the major surfaces has an adhesive thereon and is configured to overlie a theft protection sensor and adhere to an article to be protected. At least one weakness formation is provided in the label adjacent the periphery thereof.

11 Claims, 3 Drawing Sheets

TAMPER EVIDENT LABEL AND ARTICLE INCORPORATING THE SAME

CROSS-REFERENCE TO RELATED APPLICATION

This application claims the benefit of U.S. Provisional Application No. 62/743,415 filed on Oct. 9, 2018, the entire contents of which are incorporated herein by reference.

FIELD

The subject disclosure relates to theft prevention and in particular, to a tamper evident label and article incorporating the same.

BACKGROUND

Shoplifting is a problem faced by almost all retailers. Not surprisingly therefore, antishoplifting systems in retail establishments have become common place. For example, acoustomagnetic (AM) antishoplifting systems are widely used to prevent theft of merchandise from retail establishments. AM antishoplifting systems make use of AM sensors made of a combination of special magnetic materials that generate an ultrasonic response when triggered. The AM sensors are attached in some way to the merchandise that is to be protected. Detection systems are typically placed at or near the exits of the retail establishments. The detection systems generate an activating field through which patrons leaving the retail establishments must pass and detect the characteristic ultrasonic response of AM sensors when the AM sensors are triggered by the activating field. One or more units to deactivate the AM sensors by changing their internal states are provided near retail establishment checkout stations so that AM sensors attached to purchased merchandise can be deactivated.

Typical AM sensors are in the form of three-dimensional rectangular strips, with approximate dimensions of 1.75 in. by 0.40 in. by 0.06 in. to 0.08 in. The AM sensors may have one surface with a pressure sensitive adhesive to permit affixing of the AM sensors to the merchandise to be protected or the AM sensors may have no adhesive and simply be placed loosely in the merchandise to be protected.

Although AM antishoplifting systems have proven to be useful, drawbacks do exist. Unfortunately, the AM sensor package is quite rigid due to the fact that any appreciable bend in the package (of more than a few degrees) will degrade its performance significantly. As a result, AM sensors do not wrap around curved items but rather sit flat. This is combination with the small footprint of AM sensors sometimes makes it easy for individuals to insert a fingernail or other similar tool under the AM sensors, break the adhesive bond between the AM sensors and the merchandise to be protected and flip the AM sensors off the merchandise. This of course negates the effectiveness of protection the AM sensors are designed to provide.

To make it more difficult to remove AM sensors from merchandise, a printed AM sensor cover label made of destructible film and with a strong adhesive has been developed by Custom Security Industries Inc. of Thornhill, Ontario, Canada and sold under the name AM Protect. The AM sensor cover label with an AM sensor incorporated thereunder, is configured to be applied to merchandise to be protected. When the AM sensor cover label and AM sensor combination is properly applied to the merchandise, the edges of the AM sensor cover label seal tightly to the surface of the merchandise, making it difficult to peel the edges of the AM sensor cover label up and away and remove it from the merchandise. Also, the destructible film of the AM sensor cover label readily fractures when attempts are made to peel the edges of the AM sensor cover label. As a result, it becomes a slow and laborious task to pick the AM sensor cover label off the merchandise to expose the underlying AM sensor and as a result, the AM sensor cover label acts as a good theft deterrent.

While often very effective, the AM sensor cover label does have drawbacks. With some care and experience, it is possible for an individual to grasp the AM sensor cover label along an edge and pull on it thereby removing the AM sensor cover label from the merchandise and exposing the AM sensor. Also, the AM sensor cover label does not work well on all merchandise. In order to be effective, the AM sensor cover label relies on a high degree of adhesion between the AM sensor cover label and the surface of the merchandise to be protected. If there is not enough adhesion between the AM sensor cover label and the merchandise, the AM sensor cover label may be too easy to remove from the merchandise significantly reducing its effectiveness as a theft prevention device. In addition, the height of the AM sensor may cause the AM sensor cover label to tent when placed over the AM sensor i.e. one or more air pockets may surround the AM sensor. If these air pockets extend to the edge of the AM sensor cover label, the air pockets may provide easy access to a free edge of the AM sensor cover label allowing an individual to pull the AM sensor cover label off of the merchandise to be protected and expose the AM sensor. While it is always possible to make the AM sensor cover label larger and reduce the chance that an air pocket extends to a free edge of the AM sensor cover label, for esthetic and packaging reasons, it will be appreciated that smaller AM sensor cover label footprints are preferred. Improvements are therefore desired.

It is therefore an object to provide a novel tamper evident label and to an article incorporating the same.

SUMMARY

It should be appreciated that this summary is provided to introduce a selection of concepts in a simplified form that are further described below in the detailed description and with reference to drawings. This summary is not intended to be used to limit the scope of the claimed subject matter.

Accordingly, in one aspect there is provided a tamper evident label formed of destructible material and having opposite major surfaces, one of the major surfaces having an adhesive thereon and configured to overlie a theft protection sensor and adhere to an article to be protected, wherein at least one weakness formation is provided in the label adjacent the periphery thereof.

The at least one weakness formation provides an exit path for air trapped between the label and the article when the label is placed over the theft protection sensor and on the article and facilitates fracturing of the label when an attempt to remove the label from the article is made.

In one embodiment, the at least one weakness formation is a pattern of weakness about the periphery of the label. The pattern of weakness may comprise spaced cuts and/or perforations provided in the label about the periphery thereof. In one form, the pattern of weakness comprises spaced cuts about the periphery of the label that are arranged in a saw-toothed pattern. In another embodiment, the pattern of weakness comprises at least one ring of perforations about the periphery of the label.

In another embodiment, the at least one weakness formation comprises discrete, spaced weakness formations about the periphery of the label. In one form, the weakness formations have the same geometric shape. The geometric shape may be one of linear, circular or serpentine. Each weakness formation may comprise one of a continuous cut provided in the label or discontinuous cuts provided in the label.

According to another aspect there is provided an article comprising the label described in any one of the preceding paragraphs, wherein the label is adhered to the article and traps the theft protection sensor between the label and the article.

According to another aspect there is provided a tamper evident label formed of destructible material and having opposite major surfaces, one of the major surfaces having an adhesive thereon and configured to overlie a theft protection sensor and adhere to merchandise to be protected thereby to trap the theft protection sensor between the label and the merchandise, wherein at least one weakness formation is provided in the label about the periphery of the label, the at least one weakness formation providing an exit path for air trapped between the label and the merchandise when the label is adhered to the merchandise and facilitating fracturing of the label when an attempt to remove the label from the merchandise is made.

BRIEF DESCRIPTION OF THE DRAWINGS

Embodiments will now be described more fully with reference to the accompanying drawings in which.

DETAILED DESCRIPTION

Figure 1:
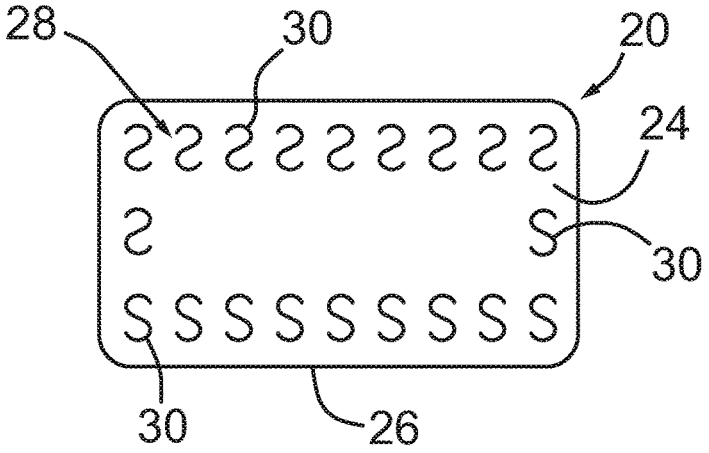
FIG. 1 is a top plan view of a tamper evident label.

The foregoing summary, as well as the following detailed description of certain examples will be better understood when read in conjunction with the accompanying drawings. As used herein, an element or feature introduced in the singular and preceded by the word "a" or "an" should be understood as not necessarily excluding the plural of the elements or features. Further, references to "one example" or "one embodiment" are not intended to be interpreted as excluding the existence of additional examples or embodiments that also incorporate the described elements or features. Moreover, unless explicitly stated to the contrary, examples or embodiments "comprising" or "having" or "including" an element or feature or a plurality of elements or features having a particular property may include additional elements or features not having that property. Also, it will be appreciated that the terms "comprises", "has", "includes" means "including by not limited to" and the terms "comprising", "having" and "including" have equivalent meanings.

As used herein, the term "and/or" can include any and all combinations of one or more of the associated listed elements or features.

It will be understood that when an element or feature is referred to as being "on", "attached" to, "connected" to, "coupled" with, "contacting", etc. another element or feature, that element or feature can be directly on, attached to, connected to, coupled with or contacting the other element or feature or intervening elements may also be present. In contrast, when an element or feature is referred to as being, for example, "directly on", "directly attached" to, "directly connected" to, "directly coupled" with or "directly contacting" another element of feature, there are no intervening elements or features present.

It will be understood that spatially relative terms, such as "under", "below", "lower", "over", "above", "upper", "front", "back", "top", "bottom" and the like, may be used herein for ease of description to describe the relationship of an element or feature to another element or feature as illustrated in the figures. The spatially relative terms can however, encompass different orientations in use or operation in addition to the orientation depicted in the figures.

In the following, a tamper evident label is described. Broadly, the tamper evident label is formed of destructible material and has opposite major surfaces. One of the major surfaces has an adhesive thereon and is configured to overlie a theft protection sensor and adhere to an article such as merchandise to be protected thereby to trap the theft protection sensor between the label and the article. At least one weakness formation is provided in the label adjacent the periphery thereof. The at least one weakness formation provides an exit path for air trapped between the label and the article when the label is placed over the theft protection sensor and on the article and facilitates fracturing of the label when an attempt to remove the label from the article is made.

Figure 2:
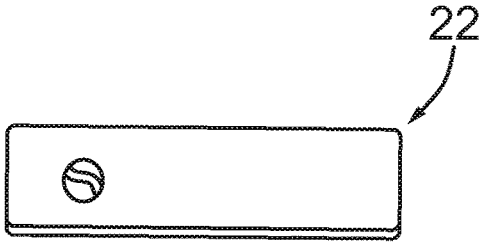
FIG. 2 is a top plan view of a theft protection sensor.

Turning now to FIGS. 1 and 2, an exemplary tamper evident label is shown and is generally identified by reference number 20. The tamper evident label 20 is designed to be affixed to merchandise to be protected such as retail packaging (e.g. bottles, boxes etc.) and overlie a theft protection sensor 22. In this embodiment, the theft protection sensor 22 is a rectangular acoustomagnetic (AM) sensor. The tamper evident label 20 has a major upper surface 24 and an opposite major bottom surface 26 and is generally rectangular in plan. In this embodiment, the tamper evident label 20 is formed of a destructible plastic film such as polystyrene.

An aggressive, high tack adhesive is provided on the major bottom surface 26. The adhesive is common to the label industry and works well both at room temperatures and at low (i.e. freezer) temperatures when affixed to packages used in retails products, primarily boxes and bottles that are surface coated in a variety of finishes.

At least one weakness formation 28 is provided in the tamper evident label 20 adjacent its periphery. In this embodiment, the at least one weakness formation 28 is in the form of discrete, continuous S-shaped or serpentine cuts 30 provided in the tamper evident label 20. The cuts 30 are generally evenly spaced about the periphery of the tamper evident label 20 and extend from near the peripheral edges of the tamper evident label partially inwardly to define a central region 32 devoid of cuts. The central region 32 has dimensions larger than the theft protection sensor 22. The serpentine cuts 30 serve two purposes, namely to weaken the tamper evident label 20 in a controlled and predictable manner and to provide exit paths so that air pockets are not trapped under the tamper evident label 20 when the tamper evident label is applied to merchandise to be protected. Custom or standard printing (not shown) is provided on the major upper surface 24 of the tamper evident label 20 within the central region 32 that obscures the theft protection sensor 22 from sight The tamper evident label 20 has a small footprint to minimize its impact on aesthetics. In this embodiment, the dimensions of the tamper evident label are 2¾" by 1⅜" although those of skill in the art will appreciate that the dimensions of the tamper evident label can be varied to suit the environment in which the tamper evident label 20 is deployed.

Figure 2A:
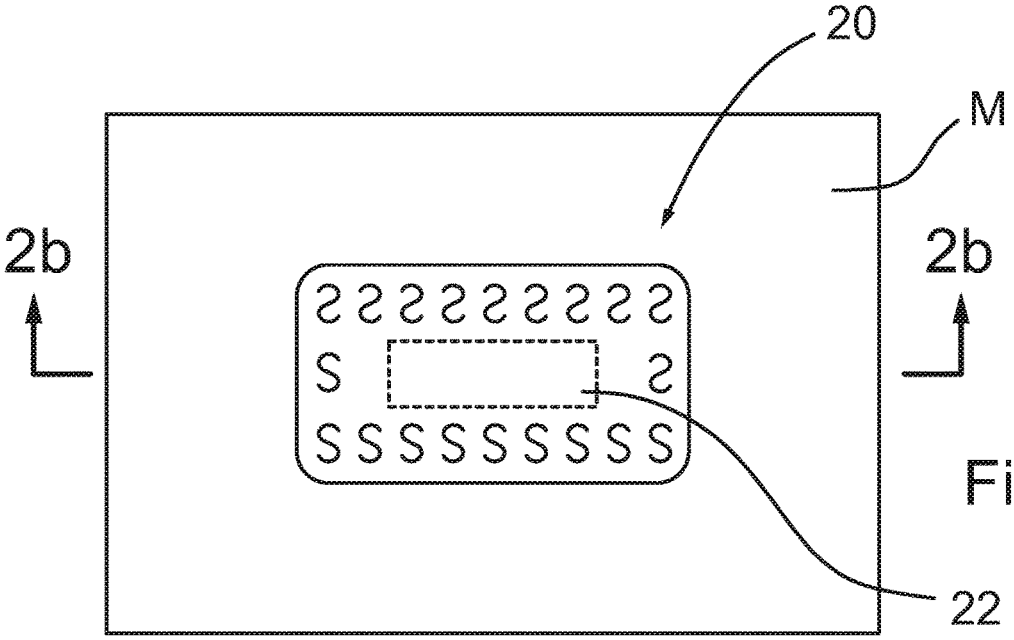
FIG. 2*a* is a top plan view of the tamper evident label of FIG. 1 applied to merchandise and overlying the theft protection sensor of FIG. 2.
Figure 2B:
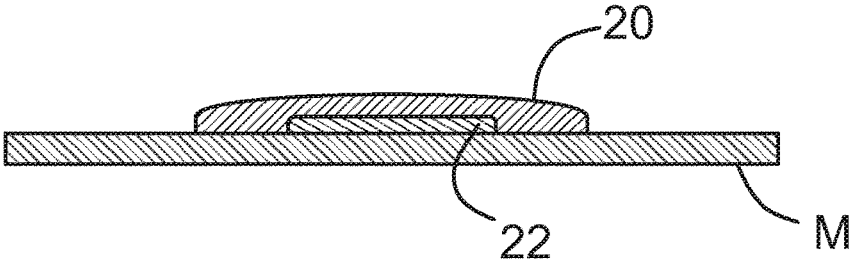
FIG. 2*b* is a cross-sectional view of the tamper evident label, merchandise, and theft protection sensor shown in FIG. 2*a* taken along line 2*b*-2*b*.

In use as shown in FIGS. 2*a* and 2*b*, the tamper evident label 20 is applied to merchandise M to be protected such that the central region 32 of the tamper evident label 20 overlies the theft protection sensor 22 and obscures it from view. During application of the tamper evident label 20, the cuts 30 provide exit paths for air to escape thereby eliminating or at least minimizing the occurrence of tenting around the perimeter of the tamper evident label 20. This allows the tamper evident label 20 to sit flat on the merchandise M to be protected resulting in the tamper evident seal 20 providing a tight seal with the merchandise. As a result, it is very difficult to gain a fingerhold on any edge of the tamper evident label 20, a prerequisite to removing it. Also, the cuts 30 weaken the tamper evident label 20 so that fracturing of the tamper evident label occurs easily and widely when an attempt to remove the tamper evident label 20 from the merchandise is made, providing easy to detect, visual evidence of the removal attempt.

Figure 3A:
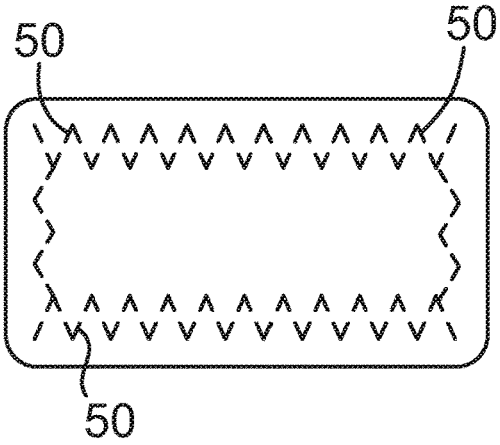
FIGS. 3*a* to 3*g* are top plan views of alternative tamper evident labels.
Figure 3B:
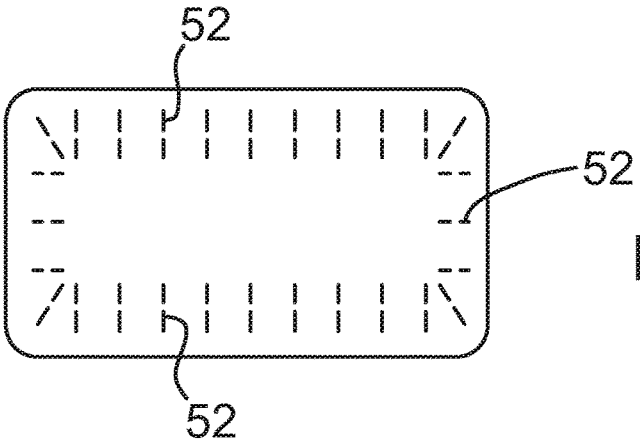
Figure 3C:
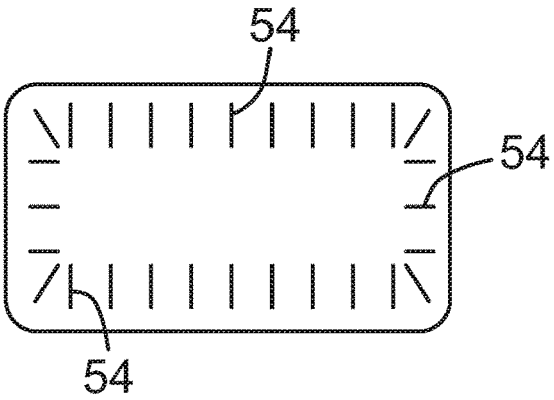
Figure 3D:
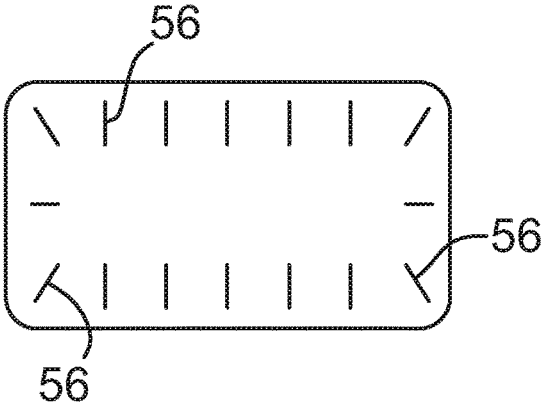
Figure 3E:
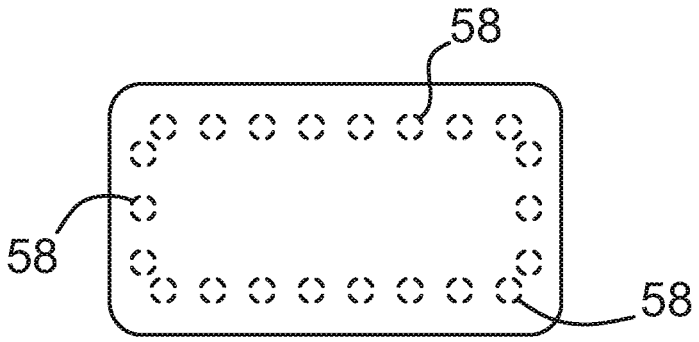
Figure 3F:
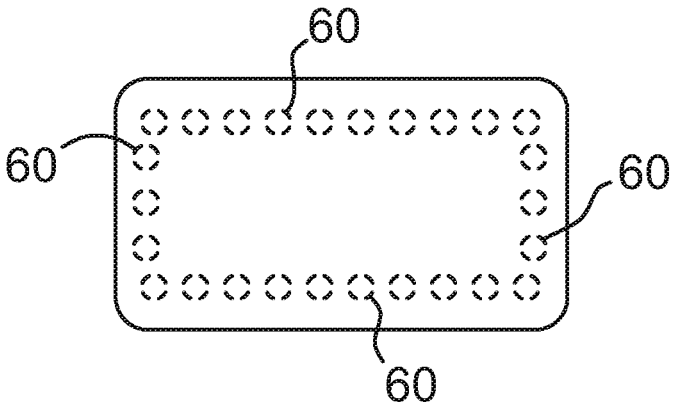
Figure 3G:
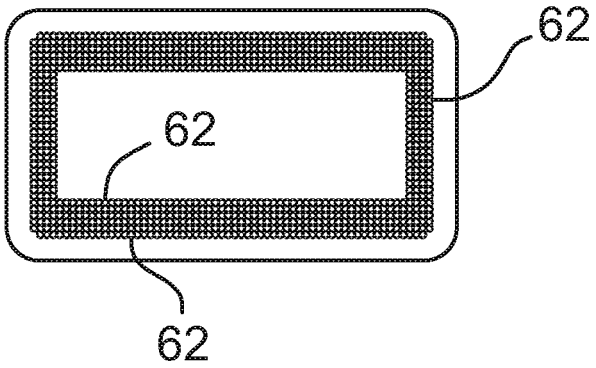

Although the at least one weakness formation 28 described above comprises discrete, spaced, continuous S-shaped or serpentine cuts 30, those of skill in the art will appreciate that the at least one weakness formation 28 may take other forms. For example, FIGS. 3*a* to 3*g* show tamper evident labels with alternative weakness formations. In FIG. 3*a*, the at least one weakness formation is in the form of discontinuous, linear cuts 50 arranged in a saw-toothed pattern about the periphery of the tamper evident label 20 that surrounds the central region. In FIG. 3*b*, the at least one weakness formation comprises discrete, spaced, discontinuous linear cuts 52 about the periphery of the tamper evident label 20 with each cut extending from near a peripheral edge of the tamper evident label partially inwardly. In FIG. 3*c*, the at least one weakness formation is similar to that of FIG. 3*b* except that each of the linear cuts 54 is continuous. In FIG. 3*d*, the at least one weakness formation is also in the form of discrete, spaced, continuous linear cuts 56 about the periphery of the tamper evident label 20 with each cut extending from near a peripheral edge of the tamper evident label partially inwardly. In FIG. 3*e*, the at least one weakness formation is in the form of discrete, spaced, discontinuous circular cuts 58 about the periphery of the tamper evident label 20 that surround the central region. In FIG. 3*h*, the at least one weakness formation is also in the form of discrete, spaced, discontinuous circular cuts 60 about the periphery of the tamper evident label 20 that surround the central region. In FIG. 3*g*, the at least one weakness formation is in the form of rectangular, concentric rings of perforations 62.

While exemplary weakness formations are shown and described above, those of skill in the art will appreciate that alternative arrangements of weakness formations comprising cuts, perforations or both having other geometric shapes or combinations of shapes may be employed. Also, although the locations of the weakness formations are shown to define a central region devoid of cuts and/or perforations, those of skill in the art will appreciate that the cuts and/or perforations may extend further inwardly to an extent where the cuts and/or perforations extend over the theft protection sensor 22. Also, in some circumstances, the cuts and/or perforations may extend to the peripheral edges of the tamper evident label 20.

Although the tamper evident label 20 has been described as being formed of a polystyrene plastic film, those of skill in the art will appreciate that the tamper evident label may be formed of other suitable material. For example, other plastic films such as polyester, polypropylene and acetate may be employed. Alternatively, papers, coextruded composites and composites of paper and plastic film may be used.

Although the tamper evident labels have been described as being for use on merchandise, those of skill in the art will appreciate that the tamper evident labels may be used on other articles of commercial or personal value that are to be protected.

As will be appreciated, the tamper evident labels described above offer advantageous. The small footprint of the tamper evident labels has less impact on the aesthetics of merchandise to be protected. The tamper evident labels provide an excellent seal around their peripheral edges making them difficult to pry up and away from the merchandise to which they are adhered. The tamper evident labels fracture easily when a fingernail or other tool is used to attack their edges providing noticeable visual evidence of tampering attempts. The tamper evident labels eliminate or at least minimize tenting. Furthermore, the tamper evident labels can be manufactured cost effectively and applied to merchandise easily and safely.

As used herein, the term "configured" means that the element, component, or other subject matter is designed and/or intended to perform a given function. Thus, the use of the term "configured" should not be construed to mean that a given element, component, or other subject matter is simply "capable of" performing a given function but that the element, component, and/or other subject matter is specifically selected, created, implemented, utilized, and/or designed for the purpose of performing the function.

Although embodiments have been described above and are shown in the accompanying drawings, it will be appreciated by those skilled in the art that variations and modifications may be made without departing from the scope defined by the appended claims, and the scope of the claims should be given the broadest interpretation consistent with the specification as a whole.

What is claimed is:

1. An article comprising a tamper evident label and a theft protection sensor, wherein the tamper evident label is adhered to the article and traps the theft protection sensor between the tamper evident label and the article, wherein the tamper evident label is formed of destructible material and has opposite major surfaces and an outer peripheral edge, one of the major surfaces having an adhesive thereon that overlies the theft protection sensor and at least a portion of an article surface, wherein weakness formations are provided in the tamper evident label, wherein the weakness formations are arranged in a saw-toothed pattern about and inwardly spaced from the outer peripheral edge of the tamper evident label, and wherein the saw-toothed pattern of weakness formations surrounds a central region of the tamper evident label devoid of weakness formations, the central region having dimensions larger than the dimensions of the theft protection sensor and overlying the theft protection sensor.

2. The article of claim 1, wherein the weakness formations provide an exit path for air trapped between the tamper evident label and the article during adhering of the tamper evident label to the article surface and facilitate fracturing of the tamper evident label when an attempt to remove the tamper evident label from the article is made.

3. The article of claim 2, wherein the pattern of weakness formations comprises spaced cuts and/or perforations provided in the tamper evident label.

4. The article of claim 1, wherein the pattern of weakness formations comprises spaced cuts and/or perforations provided in the tamper evident label.

5. The article of claim 1, wherein the destructible material is selected from a group consisting of polystyrene, polypropylene, and acetate.

6. Merchandise comprising a tamper evident label and a theft protection sensor, wherein the tamper evident label is adhered to the merchandise and traps the theft protection sensor between the tamper evident label and the merchandise, wherein the tamper evident label is formed of destructible material and has opposite major surfaces and an outer peripheral edge, one of the major surfaces having an adhesive thereon that overlies the theft protection sensor and adheres to theft protection sensor and to the merchandise, wherein weakness formations arranged in a pattern are provided in the tamper evident label about and inwardly spaced from the outer peripheral edge of the tamper evident label, wherein the pattern of weakness formations is a saw-toothed pattern forming at least one ring surrounding a central region of the tamper evident label devoid of weakness formations that has dimensions larger than the dimensions of the theft protection sensor, wherein the central region overlies the theft protection sensor, and wherein the weakness formations provide an exit path for air trapped between the tamper evident label and the merchandise during adhering of the tamper evident label to the merchandise with the central region overlying the theft protection sensor and facilitate fracturing of the tamper evident label when an attempt to remove the tamper evident label from the merchandise is made.

7. The merchandise of claim 6, wherein the pattern of weakness formations comprises linear cuts and/or perforations provided in the label.

8. The article of claim 6, wherein the destructible material is selected from a group consisting of polystyrene, polypropylene, and acetate.

9. An article comprising a tamper evident label and a theft protection sensor, wherein the tamper evident label is adhered to the article and traps the theft protection sensor between the tamper evident label and the article, wherein the tamper evident label is formed of destructible material and has opposite major surfaces and an outer peripheral edge, one of the major surfaces having an adhesive thereon that overlies the theft protection sensor and at least a portion of an article surface, wherein weakness formations are provided in the tamper evident label, wherein the weakness formations are arranged in a pattern about and inwardly spaced from the outer peripheral edge of the tamper evident label, wherein the pattern of weakness formations comprises concentric rings of perforations, and wherein the pattern of weakness formations surrounds a central region of the tamper evident label devoid of weakness formations, the central region having dimensions larger than the dimensions of the theft protection sensor and overlying the theft protection sensor.

10. The article of claim 9, wherein the weakness formations provide an exit path for air trapped between the tamper evident label and the article during adhering of the tamper evident label to the article surface and facilitate fracturing of the tamper evident label when an attempt to remove the tamper evident label from the article is made.

11. Merchandise comprising a tamper evident label and a theft protection sensor, wherein the tamper evident label is adhered to the merchandise and traps the theft protection sensor between the tamper evident label and the merchandise, wherein the tamper evident label is formed of destructible material and has opposite major surfaces and an outer peripheral edge, one of the major surfaces having an adhesive thereon that overlies the theft protection sensor and adheres to theft protection sensor and to the merchandise, wherein weakness formations arranged in a pattern are provided in the tamper evident label about and inwardly spaced from the outer peripheral edge of the tamper evident label, wherein the pattern of weakness formations comprises concentric rings of perforations surrounding a central region of the tamper evident label devoid of weakness formations that has dimensions larger than the dimensions of the theft protection sensor, wherein the central region overlies the theft protection sensor, and wherein the weakness formations provide an exit path for air trapped between the tamper evident label and the merchandise during adhering of the tamper evident label to the merchandise with the central region overlying the theft protection sensor and facilitate fracturing of the tamper evident label when an attempt to remove the tamper evident label from the merchandise is made.

* * * * *